US011073280B2

(12) United States Patent
Wiklof

(10) Patent No.: US 11,073,280 B2
(45) **Date of Patent: *Jul. 27, 2021**

(54) ELECTRODYNAMIC CONTROL IN A BURNER SYSTEM

(71) Applicant: CLEARSIGN TECHNOLOGIES CORPORATION, Seattle, WA (US)

(72) Inventor: Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 117 days.

This patent is subject to a terminal disclaimer.

(21) Appl. No.: 16/296,623

(22) Filed: Mar. 8, 2019

(65) Prior Publication Data

US 2019/0203935 A1 Jul. 4, 2019

Related U.S. Application Data

(60) Continuation-in-part of application No. 15/654,026, filed on Jul. 19, 2017, now abandoned, which is a (Continued)

(51) Int. Cl.
*F23N 1/00* (2006.01)
*F23N 5/00* (2006.01)

(Continued)

(52) U.S. Cl.
CPC ..... *F23N 1/002* (2013.01); *F23C 99/001* (2013.01); *F23N 5/00* (2013.01); *F23N 5/123* (2013.01);

(Continued)

(58) Field of Classification Search
CPC ..... F23C 2201/00; F23C 2900/00; F23C 99/001; F23D 14/84; F23N 5/00; F23N 1/00
See application file for complete search history.

(56) References Cited

U.S. PATENT DOCUMENTS 1,153,182 A 9/1915 Schniewind et al.
2,095,065 A 10/1937 Hays (Continued)

FOREIGN PATENT DOCUMENTS

EP 0844434 5/1998
EP 1139020 8/2006

(Continued)

OTHER PUBLICATIONS

U.S. Appl. No. 14/206,919, filed Mar. 12, 2014.

(Continued)

*Primary Examiner* — David J Laux
*Assistant Examiner* — Nikhil P Mashruwala
(74) *Attorney, Agent, or Firm* — Dorsey & Whitney LLP

(57) ABSTRACT

A burner system and a retrofit flame control system for an existing burner system are disclosed. The burner system may include burner components, electrodynamic components, and a data interface. The data interface may receive a command for controlling the burner components and prepare a command for controlling the electrodynamic components at least partially based on the command for controlling the burner components.

20 Claims, 7 Drawing Sheets

Related U.S. Application Data division of application No. 14/206,919, filed on Mar. 12, 2014, now Pat. No. 9,732,958, which is a continuation-in-part of application No. 12/753,047, filed on Apr. 1, 2010, now Pat. No. 8,851,882.

(60) Provisional application No. 61/806,480, filed on Mar. 29, 2013.

(51) Int. Cl.
*F23C 99/00* (2006.01)
*F23N 5/12* (2006.01)

(52) U.S. Cl.
CPC ..... *F23N 2223/10* (2020.01); *F23N 2229/12* (2020.01)

(56) References Cited

U.S. PATENT DOCUMENTS 2,604,936 A 7/1952 Kaehni et al.
3,087,472 A 4/1963 Yukichi
3,129,062 A 4/1964 Ongkiehong et al.
3,167,109 A 1/1965 Wobig
3,224,485 A 12/1965 Griffiths et al.
3,306,338 A 2/1967 Wright et al.
3,358,731 A 12/1967 Donnelly et al.
3,416,870 A 12/1968 Wright
3,503,348 A 3/1970 Dvirka
3,749,545 A 7/1973 Velkoff
3,841,824 A 10/1974 Bethel et al.
3,869,362 A 3/1975 Machi et al.
4,052,139 A 10/1977 Paillaud et al.
4,091,779 A 5/1978 Saufferer et al.
4,093,430 A 6/1978 Schwab et al.
4,110,086 A 8/1978 Schwab et al.
4,111,636 A 9/1978 Goldberg et al.
4,118,202 A 10/1978 Scholes
4,219,001 A 8/1980 Abe et al.
4,260,394 A 4/1981 Rich
4,304,096 A 12/1981 Liu et al.
4,340,024 A 7/1982 Suzuki et al.
4,439,980 A 4/1984 Biblarz et al.
4,473,349 A 9/1984 Kumatsu et al.
4,483,673 A 11/1984 Murai et al.
4,519,770 A 5/1985 Kesselring et al.
4,576,029 A 3/1986 Miyake et al.
4,643,667 A 2/1987 Fleming
4,649,260 A 3/1987 Melis et al.
4,673,349 A 6/1987 Abe et al.
4,675,029 A 6/1987 Norman et al.
4,752,213 A 6/1988 Grochowski et al.
4,903,616 A 2/1990 Mavroudis
4,987,839 A 1/1991 Krigmont et al.
5,049,063 A 9/1991 Kishida et al.
5,441,402 A 8/1995 Reuther et al.
5,511,974 A 4/1996 Gordon et al.
5,571,007 A * 11/1996 Ishiguro ..... F23N 5/242 431/13
5,702,244 A 12/1997 Goodson et al.
5,784,889 A 7/1998 Joos et al.
5,957,682 A 9/1999 Kamal et al.
6,159,001 A 12/2000 Kushch et al.
6,205,765 B1 3/2001 Iasillo et al.
6,247,921 B1 6/2001 Helt
6,640,549 B1 11/2003 Wilson et al.
6,736,133 B2 5/2004 Bachinski et al.
6,742,340 B2 6/2004 Nearhoof et al.
6,918,755 B1 7/2005 Johnson et al.
6,997,701 B2 2/2006 Volkert et al.
7,137,808 B2 11/2006 Branston et al.
7,168,427 B2 1/2007 Bachinski et al.
7,182,805 B2 2/2007 Reaves
7,226,496 B2 6/2007 Ehlers
7,226,497 B2 6/2007 Ashworth
7,243,496 B2 * 7/2007 Pavlik ..... F23C 99/001 431/2
7,377,114 B1 5/2008 Pearce
7,523,603 B2 4/2009 Hagen et al.
7,845,937 B2 * 12/2010 Hammer ..... F23N 3/002 431/2
8,082,725 B2 12/2011 Younsi et al.
8,245,951 B2 8/2012 Fink et al.
8,851,882 B2 * 10/2014 Hartwick ..... F23C 99/001 431/2
8,911,699 B2 12/2014 Colannino et al.
9,267,680 B2 2/2016 Goodson et al.
9,284,886 B2 3/2016 Breidenthal et al.
9,289,780 B2 3/2016 Goodson
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,195 B2 6/2016 Goodson et al.
9,441,834 B2 9/2016 Colannino et al.
9,453,640 B2 9/2016 Krichtafovitch et al.
9,469,819 B2 10/2016 Wiklof
9,494,317 B2 11/2016 Krichtafovitch et al.
9,496,688 B2 11/2016 Krichtafovitch et al.
9,513,006 B2 * 12/2016 Krichtafovitch ..... F23D 14/84
9,574,767 B2 * 2/2017 Anderson ..... H01L 31/042
9,696,034 B2 * 7/2017 Krichtafovitch ..... F23D 14/84
9,702,547 B2 * 7/2017 Krichtafovitch ..... F23C 99/001
9,732,958 B2 8/2017 Wiklof
10,281,141 B2 * 5/2019 Krichtafovitch ..... F23D 11/32
10,364,984 B2 * 7/2019 Colannino ..... F23C 99/001
10,422,523 B2 * 9/2019 Wiklof ..... F23D 14/68
10,458,647 B2 * 10/2019 Wiklof ..... F23C 5/02
2002/0088442 A1 7/2002 Hansen et al.
2003/0114977 A1 6/2003 Emord
2005/0208442 A1 9/2005 Heiligers et al.
2005/0208446 A1 9/2005 Jayne
2006/0199122 A1 9/2006 Matteson et al.
2006/0277346 A1 12/2006 Doak et al.
2007/0020567 A1 1/2007 Branston et al.
2007/0225836 A1 9/2007 Swanson
2007/0291552 A1 12/2007 Khatami et al.
2008/0145802 A1 6/2008 Hammer et al.
2009/0064661 A1 3/2009 Younsi et al.
2009/0104573 A1 * 4/2009 Chen ..... F24C 3/103 431/72
2010/0178219 A1 7/2010 Verykios et al.
2010/0183424 A1 7/2010 Roy
2011/0072786 A1 3/2011 Tokuda et al.
2011/0203771 A1 8/2011 Goodson et al.
2011/0211612 A1 9/2011 Branecky
2012/0317985 A1 12/2012 Hartwick et al.
2013/0004902 A1 1/2013 Goodson et al.
2013/0071794 A1 3/2013 Colannino et al.
2013/0170090 A1 7/2013 Colannino et al.
2013/0230810 A1 9/2013 Goodson et al.
2013/0230811 A1 9/2013 Goodson et al.
2013/0255482 A1 10/2013 Goodson et al.
2013/0255548 A1 10/2013 Goodson et al.
2013/0255549 A1 10/2013 Sonnichsen et al.
2013/0260321 A1 10/2013 Colannino et al.
2013/0323661 A1 12/2013 Goodson et al.
2013/0333279 A1 12/2013 Osler et al.
2013/0336352 A1 12/2013 Colannino et al.
2014/0038113 A1 2/2014 Breidenthal
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0196368 A1 7/2014 Wiklof
2014/0208758 A1 7/2014 Breidenthal et al.

(56) References Cited

U.S. PATENT DOCUMENTS

| | | | |
|---|---|---|---|
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0248566 | A1 | 9/2014 | Krichtafovitch et al. |
| 2014/0255855 | A1 | 9/2014 | Krichtafovitch |
| 2014/0255856 | A1 | 9/2014 | Colannino et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof et al. |
| 2014/0335460 | A1 | 11/2014 | Wiklof et al. |
| 2014/0368121 | A1 | 12/2014 | Hartwick et al. |
| 2015/0024331 | A1 | 1/2015 | Hartwick et al. |
| 2015/0064086 | A1 | 3/2015 | Colannino et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276213 | A1 | 10/2015 | Karkow et al. |
| 2015/0276217 | A1 | 10/2015 | Karkow et al. |
| 2015/0276220 | A1 | 10/2015 | Karkow et al. |
| 2015/0316261 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362178 | A1 | 12/2015 | Karkow et al. |
| 2016/0018103 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0040946 | A1 | 2/2016 | Goodson et al. |
| 2016/0091200 | A1 | 3/2016 | Colannino et al. |
| 2016/0123576 | A1 | 5/2016 | Colannino et al. |
| 2016/0138800 | A1 | 5/2016 | Anderson et al. |
| 2016/0161109 | A1 | 6/2016 | Goodson et al. |
| 2016/0161115 | A1 | 6/2016 | Krichtafovitch et al. |
| 2016/0215974 | A1 | 7/2016 | Wiklof |
| 2016/0245507 | A1 | 8/2016 | Goodson et al. |
| 2016/0245509 | A1 | 8/2016 | Karkow et al. |
| 2016/0265765 | A1 | 9/2016 | Ruiz et al. |
| 2016/0273763 | A1 | 9/2016 | Colannino et al. |
| 2016/0273764 | A1 | 9/2016 | Colannino et al. |
| 2016/0290633 | A1 | 10/2016 | Cherpeske et al. |
| 2016/0290639 | A1 | 10/2016 | Karkow et al. |
| 2016/0298836 | A1 | 10/2016 | Colannino et al. |
| 2016/0298840 | A1 | 10/2016 | Karkow et al. |
| 2016/0348899 | A1 | 12/2016 | Karkow et al. |
| 2016/0348900 | A1 | 12/2016 | Colannino et al. |
| 2016/0348901 | A1 | 12/2016 | Karkow et al. |
| 2017/0010019 | A1 | 1/2017 | Karkow et al. |
| 2017/0051913 | A1 | 2/2017 | Colannino et al. |
| 2017/0261201 | A1 | 9/2017 | Goodson et al. |
| 2017/0276346 | A1 | 9/2017 | Colannino et al. |
| 2017/0314782 | A1 | 11/2017 | Wiklof |
| 2018/0003378 | A1 | 1/2018 | Karkow et al. |
| 2018/0023807 | A1 | 1/2018 | Karkow et al. |
| 2018/0023810 | A1 | 1/2018 | Karkow et al. |
| 2018/0031229 | A1 | 2/2018 | Karkow et al. |
| 2018/0073727 | A1 | 3/2018 | Colannino |
| 2018/0087774 | A1 | 3/2018 | Karkow et al. |
| 2019/0011123 | A1 | 1/2019 | Dansie et al. |

FOREIGN PATENT DOCUMENTS

| | | | | |
|---|---|---|---|---|
| EP | 2738460 | | 6/2014 | |
| GB | 932955 | | 7/1963 | |
| JP | 60-216111 | | 10/1985 | |
| JP | 61-265404 | | 11/1986 | |
| JP | H 07-48136 | | 2/1995 | |
| WO | WO 1995/000803 | | 1/1995 | |
| WO | WO96/01394 | * | 1/1996 | ..... F24C 11/00 |
| WO | WO 9601394 | | 1/1996 | |
| WO | WO 2013/181569 | | 12/2013 | |
| WO | WO 2014/127311 | | 8/2014 | |
| WO | WO 2015/017084 | | 2/2015 | |
| WO | WO 2015/089306 | | 6/2015 | |
| WO | WO 2015/103436 | | 7/2015 | |
| WO | WO 2015/123683 | | 8/2015 | |
| WO | WO 2015/123694 | | 8/2015 | |
| WO | WO 2017/124008 | | 7/2017 | |

OTHER PUBLICATIONS

U.S. Appl. No. 61/806,480, filed Mar. 29, 2013.

Arnold Schwarzenegger, "A Low NOx Porous Ceramics Burner Performance Study," California Energy Commission Public Interest Energy Research Program, Dec. 2007, San Diego State University Foundation, p. 5.

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

M. Zake et al., "Electric Field Control of NOx Formation in the Flame Channel Flows." Global Nest: The Int. J. May 2000, vol. 2, No. 1, pp. 99-108.

Altendorfner et al., "Electric Field Effects on Emissions and Flame Stability With Optimized Electric Field Geometry," Third European Combustion Meeting ECM 2007, p. 1-6.

James Lavvton and Felix J. Weinberg, "Electrical Aspects of Combustion", Clarendon Press, Oxford. 1969.

William T. Brande, "The Bakerian Lecture: On Some New Electro-Chemical Phenomena", Phil. Trans. R. Soc. Lond. 1814, p. 51-61.

* cited by examiner

ELECTRODYNAMIC CONTROL IN A BURNER SYSTEM

CROSS-REFERENCE TO RELATED APPLICATIONS

This application is a continuation-in-part of U.S. application Ser. No. 15/654,026 filed on Jul. 19, 2017, which is a division of U.S. application Ser. No. 14/206,919 filed on 12 Mar. 2014 (now U.S. Pat. No. 9,732,958), which is a continuation-in-part of U.S. application Ser. No. 12/753,047 filed on 1 Apr. 2010 (now U.S. Pat. No. 8,851,882 issued on 7 Oct. 2014) and claims priority to U.S. Provisional Patent Application No. 61/806,480 filed on 29 Mar. 2013. The disclosure of each of the foregoing applications, to the extent not inconsistent with the disclosure herein, is incorporated by reference, in its entirety, by this reference.

BACKGROUND

There are many technologies where heat is needed and the heat is often generated by burning fuel in a burner system. The fuel is delivered to the burner system and combustion occurs in a flame area (e.g., at the nozzle), resulting in a flame. In some instances, legacy burner systems may have lower efficiencies than newer burner systems, which may include various improvements over the legacy burner systems. Generally, increasing efficiency of the legacy burner systems may be desirable for any number of reasons, such as to reduce fuel cost, reduce emissions, increase output, etc.

In some instances, replacing a legacy burner system may be cost prohibitive or otherwise undesirable. For example, cost of a new system (even when amortized over its useful lifetime) may outweigh fuel savings. Sometimes, a legacy burner system may be updated or retrofitted to improve its efficiency, reduce emissions, and the like.

Accordingly, manufacturers and users of burner systems continue to seek improvements for modifying or retrofitting existing burner systems.

SUMMARY

Embodiments disclosed herein relate to combustion systems, retrofit flame control systems, and methods for controlling a flame in a combustion or burner system. The burner system includes one or more burner components configured to control at least one of supply of fuel to a flame area or fuel mixture for forming the flame in the flame area. The burner system further includes one or more electrodynamic components including one or more electrodes configured to control one or more characteristics of the flame. The burner system additionally includes a data interface configured to receive a first command for controlling the burner components and to prepare a second command for controlling at least one of the one or more electrodynamic components, with the second command being at least partially based on the first command.

In an embodiment, a retrofit flame control system is disclosed. The retrofit flame control system includes one or more electrodynamic components configured for integration with an existing burner system capable of producing a flame. The one or more electrodynamic components include one or more electrodes configured to generate an electric field for controlling one or more characteristics of the flame and one or more chargers configured to charge the flame. The flame control system further includes a data interface configured to receive a first command for controlling the burner components and prepare a second command for controlling the one or more electrodynamic components, with the second command being at least partially based on the first command.

In an embodiment, a method for controlling a flame of a burner system is disclosed. The method includes receiving a first command from a control system, with the first command including information for controlling one or more of a burner or a fuel source. The method further includes preparing a second command at least partially based on the first command, with the second command including information for controlling one or more electrodynamic components that include at least one of one or more electrodes or a charger. The method additionally includes transmitting the second command to the one or more electrodynamic components.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

In the following detailed description, reference is made to the accompanying drawings, which form a part hereof. In the drawings, which are not to scale or to proportion, similar symbols typically identify similar components, unless context dictates otherwise. The illustrative embodiments described in the detailed description, drawings and claims, are not meant to be limiting. Other embodiments may be used and/or and other changes may be made without departing from the spirit or scope of the present disclosure.

DETAILED DESCRIPTION

Figure 1A:
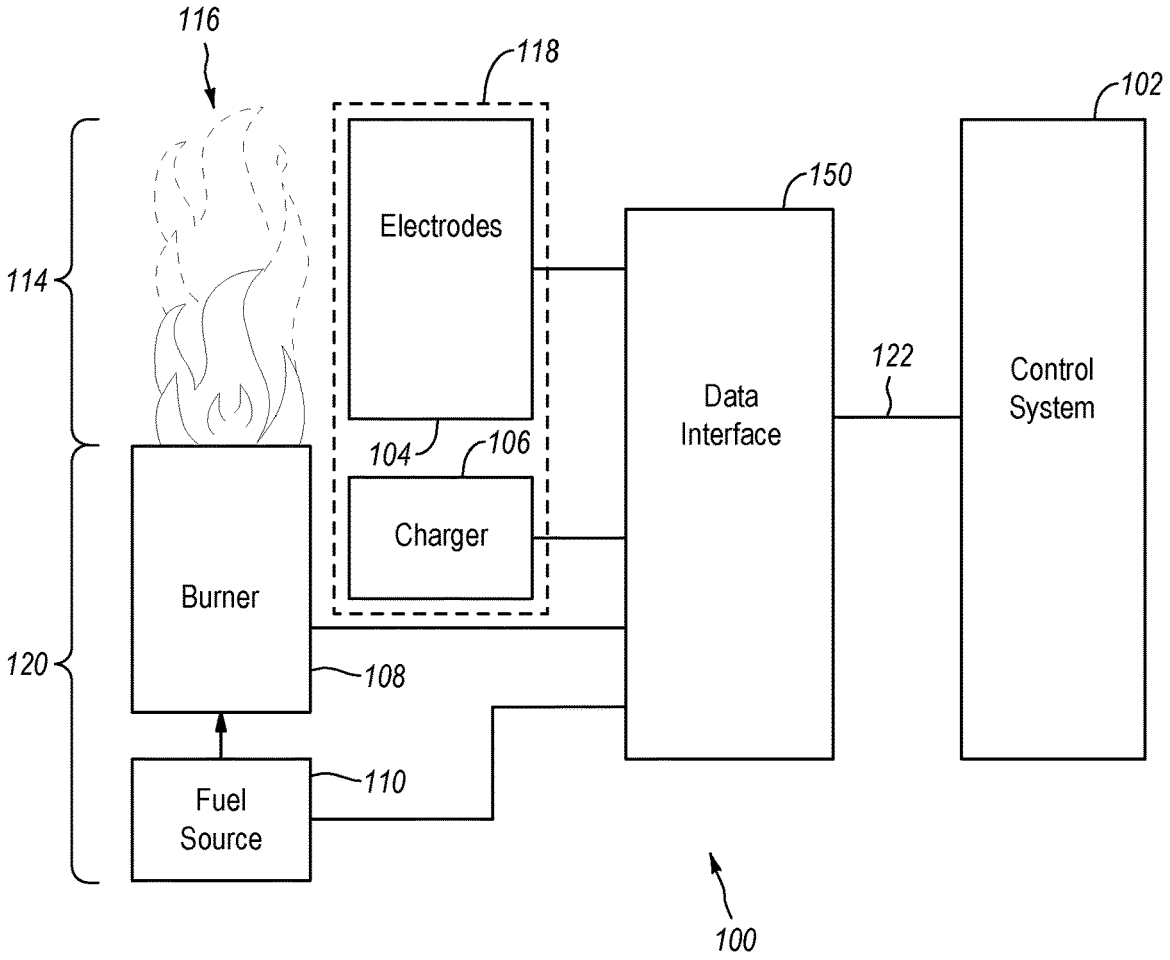
FIG. 1A is a block diagram of a burner system configured to charge a flame and control one or more characteristics of the flame according to an embodiment.

Embodiments disclosed herein relate to combustion systems, retrofit flame control systems, and methods for controlling a flame in a combustion or burner system. Embodiments disclosed herein further relate to a data interface configured to control a burner system. For example, the data interface may be integrated with burner systems including legacy burner systems and that may enable control of the burner system or control of components of the burner system.

In some instances, efficiency of a legacy burner system may be improved by controlling the flame. While the general direction of a flame may be controlled using the flame's momentum, controlling other aspects of the flame (e.g., the flame height) may further improve the efficiency of the legacy burner system. More specifically, in some embodiments, the retrofit flame control system may be easily integrated with an existing burner system to improve efficiency thereof.

An existing burner system may have several components that may be controlled by the retrofit flame control system. For instance, elements or components of the burner system may be controlled in a manner that impacts the efficiency and operation of the burner system. For example, a burner system typically has a fuel source. The operation of the burner system may be controlled by controlling various aspects or characteristics of the fuel source. Fuel flow rate, mixture ratios, fuel type, fuel temperature, fuel pressure, or the like are examples of characteristics of the fuel or of the fuel source that may be controlled. In some embodiments, the burner may also have controllable elements or components, such as valves and dampeners.

Flame geometry, flame combustion characteristics, flame chemistry, flame heat transfer (e.g., heat transfer to a surface, or non-transfer of heat to a surface), flame holding position, flame luminosity, or combinations thereof may be controlled in accordance with embodiments disclosed herein. A flame generally may include ionized gases or charged particles (ions) with the mix of positive and negative ions. Accordingly, in some instances, the flame has a net zero charge. In some embodiments, as described in more detail below, the flame may be charged to exhibit a net positive or net negative charge so that the charged flame may be manipulated via an electric field.

In at least one embodiment, application of an electric field to one or more regions at least proximate to a flame via one or more electrodes enables influencing flame geometry, flame combustion characteristics, flame chemistry, flame heat transfer (e.g., heat transfer to a surface, non-transfer of heat to a surface), flame holding position, flame luminosity, or combinations thereof. For example, by controlling a timing, a direction, a strength, a location, a waveform, a frequency spectrum of the electric field, or combinations thereof, flame geometry, flame combustion characteristics, flame chemistry, flame heat transfer, flame holding position, flame luminosity, or combinations thereof may be controllably altered.

Flame geometry may be controlled, for example, by charging the flame or the flame area and then using one or more electrodes to apply the electric field to control the flame geometry. Causing a response in the flame via the electric field may include causing a visible response in the flame. Additionally or alternatively, causing a response in the flame via the electric field may include causing increased mixing of fuel and oxidizer in the flame. Causing the increased mixing of fuel and oxidizer may increase a rate of combustion. Additionally or alternatively, causing the increased mixing of fuel and oxidizer may increase fuel and air contact in the flame. Additionally or alternatively, causing the increased mixing of fuel and oxidizer may decrease a flame temperature. Additionally or alternatively, causing the increased mixing of fuel and oxidizer may decrease an evolution of oxides of nitrogen ("NOx") by the flame. Additionally or alternatively, causing the increased mixing of fuel and oxidizer may decrease an evolution of carbon monoxide ("CO") by the flame. Causing the increased mixing of fuel and oxidizer may increase flame stability and/or decrease a chance of flame blow-out. Additionally or alternatively, causing the increased mixing of fuel and oxidizer may increase flame emissivity. Additionally or alternatively, causing the increased mixing of fuel and oxidizer may decrease flame size for a given fuel flow rate.

Embodiments disclosed herein may inject charges (e.g., electrons, positive ions, negative ions, and/or radicals) into the flame (or the fuel or the flame area) such that the flame as a whole is electrically biased either positively or negatively (i.e., the flame may have a net negative or net positive charge). By adjusting the electrical bias of the flame, the flame's geometries may also be controlled by applying an appropriate electric field. More specifically, the geometry of the flame may be controlled using one or more electrodes that may have the same charge as the biased flame or a different charge from the biased flame. In some embodiments, the electrodes may be positively charged or negatively charged. Additional or alternative embodiments may include multiple electrodes, some of which may have a negative charge and other may have a positive charge. In some embodiments, the electrodes may include at least one counter electrode (e.g., at least one ground electrode) that may also be used to generate the electric fields and to control directions and configurations of the electric fields. The counter electrodes may be included in the burner system (or in a burner configuration) to establish a desired electric field relative to other electrodes that are at a different potential. The placement and bias of the electrodes may be placed and configured according to a desired flame shape or to enable control of the flame shape according to desired ranges. For example, one or more electrodes may be positioned in or near a buoyancy-dominated region of the flame which may not even be visible as opposed to a momentum-dominated region of the flame that is at or near the base of the flame.

The polarities (e.g., positive, negative, or neutral charge) of the electrodes may be controlled such that the flame is controlled by repulsion or attraction. For example, if the flame is provided with an overall positive charge by the injection or addition of positive ions, then positive electrodes may control the flame geometry or characteristic (e.g., flame height) by repelling the biased flame. More specifically, in an embodiment, positively charged electrodes may repel positive ions in the flame. In this manner, at least the height of the flame may be controlled. In an embodiment, the electrodes may be configured to control the chemical reactions that occur during combustion. For example, forming radicals with the electrodes may create new reaction pathways during combustion, such as creating new reactive species during combustion.

Controlling the flame geometry or other characteristics of the flame may be influenced by placement of the electrodes, size and shape of the electrodes, directions of electric fields, relative potentials of the electrodes or relative strengths of the corresponding electric fields, or the like or any combination thereof. Electrodes may be placed at any number of suitable locations relative to the flame. For example, one or more electrodes may be positioned above the flame, on the sides of the flame, within the flame, or the like or any combination thereof. The electrodes also may have any number of suitable shapes and/or sizes, which may vary from one embodiment to the next, and which may be shaped like rods, rings, partial-rings, plates, or the like or any combination thereof. Also, the electrodes may also be oriented in different directions or along one or more axes. The electrodes for a given burner system may have different shapes, orientations, sizes, or the like. The electrodes in a given burner system may be similarly configured or differently configured.

Embodiments disclosed herein may also contemplate other electrodes. Other electrodes (e.g., corona electrodes) may be used to generate the ions that are added to or injected into the flame to provide a charge to the flame.

Embodiments disclosed herein further relate to a data interface that may facilitate control of at least the above-described aspects of burner systems. In some embodiments, the data interface may cooperate with multiple controllers using minimal communication lines. In an embodiment, the data interface may be effectively placed between the controllable elements of the burner system and a control system. The data interface may be able to pass data/commands, generate data/commands, route data/commands, the like, or combinations thereof.

In an embodiment, the data interface may include a lookup table ("LUT") stored in a memory. The lookup table may allow or facilitate certain actions to be performed even if not explicitly reflected in the original command. For example, a command to shut off the fuel to the burner may result in commands for other elements of the burner system. In some embodiments, the operational states of the electrodes and the charger may also be changed in response to a command to shut off the fuel to the burner.

The data interface may be configured to receive signals or commands from a control system, interpret the commands, and then route the commands as necessary to implement the original command. Some embodiments may include using the lookup table (e.g., stored in a memory), which may facilitate generating appropriate commands and sending commands to various elements or components of the burner system.

FIG. 1A illustrates an embodiment of a burner system 100 that is configured to control a flame 116. The burner system 100 includes a burner 108 and a fuel source 110. The burner 108 is connected with the fuel source 110. The fuel source 110 may provide pressurized fuel to the burner 108. Pressurizing the fuel may provide direction to the flame and may be used at least in part to control flame height. The fuel provided by the fuel source 110 combusts in the burner 108 (e.g., as the fuel exits nozzles that may be part of the burner 108) and produces the flame 116.

The burner system 100 further includes a control system 102 that is operably connected with electrodes 104, an optional charger 106, the burner 108, and the fuel source 110. In an embodiment, the electrodes 104 and the charger 106 are electrodynamic components 118, while the burner 108 and the fuel source 110 are burner components 120.

The charger 106 is configured to charge the flame 116 or to add charge to the flame 116 (or to a flame area 114). The charger 106 may charge the flame 116 using synchronized AC polarity. The charger 106 may add positive or negative ions (e.g., gaseous ions) or radicals to the flame 116, to the fuel flow, or to a flame area to produce a biased flame. As previously discussed, the flame may include ions of different charges, but the overall charge of the flame 116 may be substantially neutral. The charger 106 is configured to provide charge to or bias the flame 116. In some embodiments, the charger 106 may ensure that the overall or net charge of the flame 116 is positive or negative.

In some embodiments, the height of the flame 116 may be controlled using the existing charges in the flame and the charger 106 may not be required. Hence, in at least one embodiment, the charge and potential of the electrodes 104 may be varied and set at least partially based on the response of the flame that has not been charged by the charger 106. In some embodiments, the burner system 100 is configured to form radicals and the charger 106 may not be required. In additional or alternative embodiments the charger 106 may be omitted.

The electrodes 104 may be generally arranged relative to the flame 116 and/or to the charger 106 in a manner that the geometry of the flame 116 (e.g., the height) may be controlled. For example, the charger 106 may provide the flame 116 with a positive charge as previously stated. The electrodes 104 may also be positively biased in order to create an electric field that acts on the positively charged flame. By controlling the strength and/or direction of the electric field, the height, width, or other shape of the flame 116 may be adjusted by repelling the flame 116 with the electrodes 104, which act on the charges in the flame 116.

The electrodes 104 also may be turned off, or the potential of the electrodes 104 may be lowered in some embodiments, which would increase the height of the flame 116. In an embodiment, the potential or bias of the electrodes may be made negative, which may increase the height of the flame 116. Various other properties of the flame or related combustion characteristics other than flame geometry may also be controlled by the electric field applied via the electrodes 104 as previously discussed, such as flame combustion characteristics, flame chemistry, flame heat transfer (e.g., heat transfer to a surface, non-transfer of heat to a surface), flame holding position, flame luminosity, or combinations thereof. When controlling the flame, commands issued by the control system 102 may contemplate and account for situations where the polarity of the electrodes 104 is always positive or neutral, always negative or neutral, or where the polarity may change from positive to negative or from negative to positive.

The control system 102 may be configured to control at least one of the electrodes 104, the charger 106, the burner 108, or the fuel source 110. The control system 102 may control the potential and polarity of the electrodes 104, the amount of charge emitted or generated by the charger 106, the like, or combinations thereof. The control system 102 may also be able to control the burner 108 and the fuel source 110 (e.g., rate of fuel flow, pressure, or the like).

The burner system 100 further includes a data interface 150. The data interface 150 may be integrated in the burner system 100 to interface with the control system 102 and with the electrodynamic components 118 and the burner components 120.

The fuel source 110, for example, may include various components such as valves and dampeners. The control system 102 may issue a command to control the fuel source 110 (e.g., shut or partially close a valve or a dampener). The command may be formed as a set of bits (e.g., a command frame), for example, that may have predefined fields. The commands are received by the data interface 150 and converted into action. Thus, the interface is positioned in the burner system 100 to control the fuel source 110 in response to a command from the control system 102. Similarly, commands directed to the burner (e.g., related to fuel mixing, air flow, or the like) may be converted to action by the data interface 150. The data interface 150 may interpret commands, route commands, augment commands with additional instructions, modify commands, pass commands unmodified, the like, or any combination thereof.

In an embodiment, a communication line 122 may pass commands to the burner components 120 and to the electrodynamic components 118. One or more embodiments may allow incorporation of the electrodynamic components 118 into a legacy burner system without the need of separate control systems. The data interface 150 may generate commands for the electrodynamic components 118, which may be at least partially based on commands by the control system 102 issued to the burner components 120.

For instance, a command to reduce fuel flow may be modified by the data interface 150 to include a command to the electrodes 104 and/or the charger 106 that may be at least partially based on the command issued to the burner components 120. More generally, a command to the burner components 120 typically has a certain effect on the flame 116. The data interface 150 may issue commands to the electrodynamic components 118 that are consistent with such anticipated effect on the flame 116 (from the commands issued to the burner components 120). For example, a command to shut off the fuel flow may result in an additional command to shut off application of voltage to the electrodes 104.

In another example, a command directed to the electrodes 104 (e.g., changing a potential of an electrode, changing a direction or strength of an electric field) or a command directed to the charger 106 (e.g., controlling an amount of injected charge) may be sent on the line 122, which also may be used by the control system 102 for issuing commands to the burner components 120. The data interface 150 enables the same communication line to the control system 102 to be used for all components of the burner system 100 and may prevent commands that would not be understood or accepted by a particular component from reaching that component.

Figure 1B:
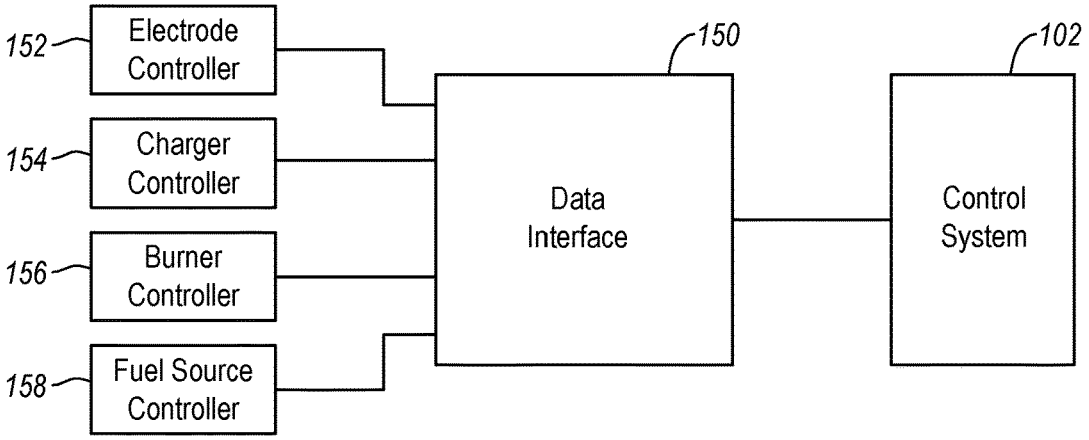
FIG. 1B is a block diagram of an embodiment of a control system in a burner system.

FIG. 1B illustrates a block diagram of an embodiment of a retrofit flame control system that may be integrated with or incorporated into a burner system. For example, in the burner system 100 (FIG. 1A), each of the electrodes 104, the optional charger 106, the burner 108, and the fuel source 110 may each be associated with their own controllers as illustrated in FIG. 1B. For instance, the data interface 150 may have an interface to the control system 102 and an interface to each of an electrode controller 152 (e.g., a nanosecond signal generator), a charger controller 154, a burner controller 156, and a fuel source controller 158. Commands from the control system 102 may be interpreted by the data interface 150 and distributed to the appropriate controller (e.g., to the electrode controller 152, charger controller 154, burner controller 156, or fuel source controller 158).

Thus, the data interface 150 may use existing communication line 122 (FIG. 1A) as well as existing communication lines to the burner 108 and the fuel source 110. The data interface 150 may have multiple input and output ("I/O") ports, such that multiple components may be electrically connected one to another in a manner illustrated in FIG. 1A or 1B.

The data interface 150 may include a connection configured to connect to one or more upline components such as the control system 102. The data interface 150 may also include a connection configured to connect to one or more downline components such as component controllers.

The data interface 150 may be embodied as a hardware device and/or as software programmed and/or stored on the hardware control system 102. The data interface 150 receives all data that originates upline. The data interface 150 may then pass data to one or more of the intended components, such as to fuel control components. The data may be reviewed prior to being passed, such that other correlated commands may be generated and sent downline to the electrodynamic control components. In some embodiments, the data interface 150 may have a multi-task operating system that may operate multiple controllers or that may control multiple components.

Figure 2:
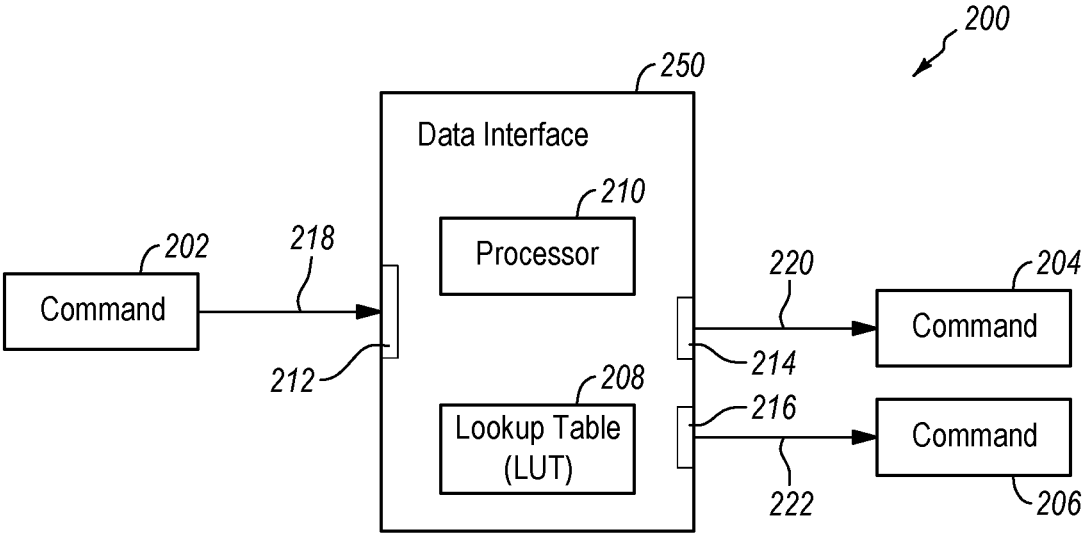
FIG. 2 is a block diagram of an embodiment of a data interface that may be incorporated in a control system to facilitate control of various components of a burner system.

FIG. 2 illustrates an embodiment of a data interface 250 that may be incorporated into a burner system. Except as otherwise described herein, the data interface 250 and a burner system 200 and their respective components or elements may be similar to or the same as the data interface 150 and the burner system 100 (FIG. 1A) and their respective components and elements. In at least one embodiment, the data interface 250 may be integrated with a legacy system and use communication lines that may be already included in the legacy system. The data interface 250 also may facilitate integration or incorporation of additional components, which may be controlled using some of the same communication lines.

The data interface 250 may include a processor 210 and a lookup table (LUT) 208. The LUT 208 may be stored in a memory and may be updated over time. The data interface 250 also may include other circuitry and components that cooperate to receive/transmit data/signals in upline and downline directions. Additionally or alternatively, the data interface 250 may be configured to access the LUT 208, which may be stored and/or located remotely from the data interface 250.

The LUT 208 may be a database or table that stores information related to the control of the burner system 200. For instance, the LUT 208 may include one or more fields that may include information or parameters that may correlate one command with another. Hence, the LUT 208 may be accessed to prepare one or more commands at least partially based on the information contained in one or more other commands. Moreover, the LUT 208 may include specific information for preparing each new command at least partially based on the one or more other commands.

In an embodiment, the LUT 208 may be accessed based on an original command 202 received over a communication line 218 that is connected to a port 212. The LUT 208 may include other commands that correspond to the original command 202. For example, when the command 202 is received by the data interface 250 and processed by the processor 210, the LUT 208 may be accessed to obtain information or parameters from preparing one or more commands that may be based on or related to the original command 202. For instance, commands 204 and 206 may be associated with and/or based on the original command 202. In one or more embodiments, the data interface 250 may generate and/or transmit both the command 204 and the command 206 in response to receiving the command 202.

For instance, the command 202 may be a command to change a pressurization of the fuel source and may be intended for the fuel source 110 or the fuel source controller 158 (FIG. 1A). In an embodiment, the data interface 250 may transmit the command 204 that is similar or identical to the command 202. Furthermore, the data interface 250 may transmit the command 206 to the electrodes. As a result, the data interface 250 may facilitate control of the electrodes 104 in a manner that is consistent with the original command 202, which was intended for the fuel source in this example.

If the change in pressurization was to increase the fuel pressure, then the command 206 to the electrodes may have been made to ensure that the flame height did not change. This enables an increase in heat without changing the flame height. Other commands may be similarly implemented.

The contents of the LUT 208 may be changed as necessary or suitable. For instance, new data may be entered into the LUT 208. The LUT 208 may be configured such that the appropriate actions are taken in response to an initial command (e.g., a command that may be provided by a user). This advantageously relieves the user of having to control each component of the burner system 200 individually. In addition, the control of the burner system 200 may be more consistent or predictable.

The command 202 may have a format that may be interpreted by the data interface 250. The command 202, for example, may identify the component to control, the specific burner affected, a value to implement, a time stamp, other information, or combination thereof. In any event, the data interface 250 may receive the command 202 and may, at least partially based on the LUT 208, prepare new commands 204, 206 at least partially based on the command 202. It should be also appreciated that the data interface 250 may receive any number of commands and may prepare and send any number of commands that may be based at least in part on the received commands. Moreover, any of the sent commands may be similar to or the same as the received commands. In other words, the data interface 250 may generate additional commands (e.g., command 206) at least partially based on the information provided in the original command (e.g., command 202).

The LUT 208 enables the data interface 250 to coordinate control of the components in the burner system 200. The LUT 208 allows the data interface 250 to generate and transmit commands to components that may not be included in the original command. The LUT 208 may be arranged in a table format that may be indexed according to all available commands. Associated portions of the table may then identify the commands that may be generated and transmitted based on the command that was received.

For example, commands that affect the fuel or the fuel flow may be correlated with commands to the charger or electrodes that have a corresponding impact on what the original command intended to achieve. A command to shut off the valve may result in the electrodes and charger being turned off. A command to increase fuel flow rate or flow pressure may result in commands that change the magnitude and/or direction of the electric field or of the amount of charge (e.g., at least one of positive ions, negative ions, electrons, or radicals) injected into the flame area.

The LUT 208 also may include routing instructions, which may indicate the destination of the command. Hence, in some embodiments, the LUT 208 may be used to determine which component should receive the command 202. For example, the LUT 208 may contain one or more fields that may be identified using information contained in the command 202, and which may include instructions for routing the command 202 to a component and/or to a port of a component.

The data interface 250 may include multiple ports, illustrated as ports 212, 214, and 216. The port 212 is an input port that is connected to the communication line 218. Advantageously, the same line 218 may be used for communicating commands to all components of the burner system 200. The ports 214 and 216 are examples of output ports and are connected to respective lines 220 and 222. The data interface 250 may include more or fewer ports in other embodiments. As a result, the data interface 250 may be scalable and may accommodate as many components as may be necessary or suitable for a particular application or burner system. The data interface 250 also may facilitate control of multiple burner systems.

For a given command 202, the number of commands output may vary and may depend on the information in the LUT 208. In an embodiment, the data interface 250 may simply pass the command 202 directly through the data interface as the command 204. Alternatively, the command 202 may be changed into two commands, illustrated as the command 204 and the command 206. The lines 218, 220, and 222 may support unidirectional or bi-directional communication. This enables, for example, feedback to be received by the data interface 250 from the various components of the burner system 200.

Figure 3:
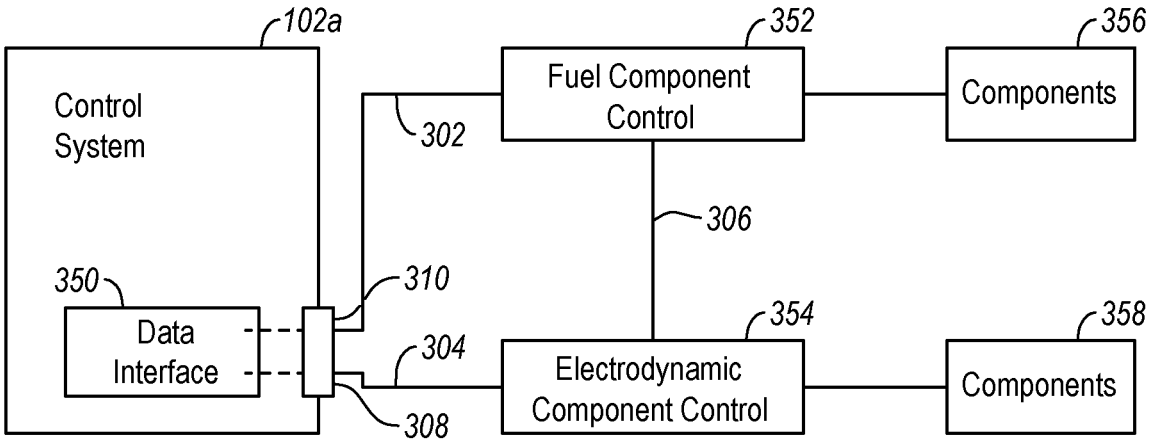
FIG. 3 is a block diagram of a control system for a burner system according to an embodiment.

FIG. 3 illustrates a block diagram of a control system for a burner system according to an embodiment. In FIG. 3, the control system 102*a* includes a data interface 350, which may be implemented as hardware, software, firmware, or combinations thereof. Except as otherwise described herein the control system 102*a* and its elements or components may be similar to or the same as the control system 102 (FIG. 1A) and its respective elements and components. In an embodiment, a single set of wires or communication lines (illustrated as lines 302, 304, and 306) are provided. One, some, or all of the commands to the fuel component control 352 or the electrodynamic component control 354 may be transmitted on the same lines. Each line or link may be unidirectional or bi-directional. In an embodiment, the data interface 350 may be associated with an output port 308 and an input port 310 (they may be the same port in one embodiment). Outgoing communications may proceed on the line 304 to the electrodynamic component control 354, then to the fuel component control 352 on the line 306 and, if necessary, back to the data interface 350 via the line 302.

In an embodiment, commands to the fuel component control 352 may be simply passed through by the electrodynamic component control 354 or vice versa if the commands travel in the other direction. The fuel component control 352 may recognize commands that are intended for the components 356 and cause the appropriate action (e.g., may send such commands to the electrodynamic component control 354). Similarly, the electrodynamic component control 354 may recognize commands that are intended for the components 358 and cause the appropriate action (e.g., may send such commands to the fuel component control 352).

The data interface 350 may have access to a LUT as previously described such that any command generated by the control system 102 may be correlated to the appropriate commands for the components 356 and/or the components 358. In this example, the electrodynamic component control 354 may pass a data stream to the fuel component control 352 while picking out the appropriate commands for the components 358. The fuel component control 352 may similarly pick out the appropriate commands for the components 356. Feedback from the electrodynamic component control 354 may be passed back to the data interface 350 through the fuel component control 352.

The foregoing description illustrates that a single set of wires or lines may be used to convey commands to all components in a burner system and ensure that each component receives the appropriate commands. It should be appreciated that embodiments may include any suitable number of sets of wires, which may vary from one embodiment to the next. Hence, additional or alternative embodiments may include multiple sets of wires, some of which may be dedicated to transmitting data between certain ones of one or more controls and/or one or more components.

Generally, the data interface may be viewed as a wedge data interface that, in an embodiment, may be inserted into legacy systems. The existing communication lines may be used to convey commands while providing a way to control new components that may be added to the system. In addition, the interface may facilitate new components to be properly controlled with legacy commands and/or with commands particular to the new components. For instance, as previously described, the LUT may ensure that commands to a fuel source results in additional commands to the electrodes or charger such that the intended result is achieved by all of the components operating appropriately in the context of the original command.

Figure 4:
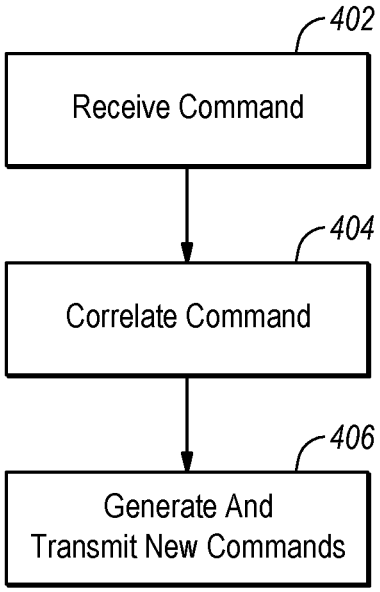
FIG. 4 is an embodiment of a method for controlling a burner system.

FIG. 4 illustrates an embodiment of a method for controlling a burner system. The method may include an act 402 of receiving a command. The command may be received, for example, from a control system or from a user via a user interface (e.g., via a graphical user interface). In an act 404, the data interface may correlate the received command with other commands. The data interface may access memory to identify commands that are correlated with the originally received command. The correlated commands may relate to other components of the burner system that, when performed, may cause the various components to work together to achieve an intent of the original command.

In an act 406, new commands (e.g., commands that correlate with the original command) may be generated. The new commands may include the original command as well as other additional commands. For example, the intent of an original command that is achieved by controlling a fuel source may be implemented with commands to the fuel source and other components that are operated to achieve the same intent as discussed herein. Moreover, in the act 406, the new commands may be transmitted to the appropriate components.

Figure 5A:
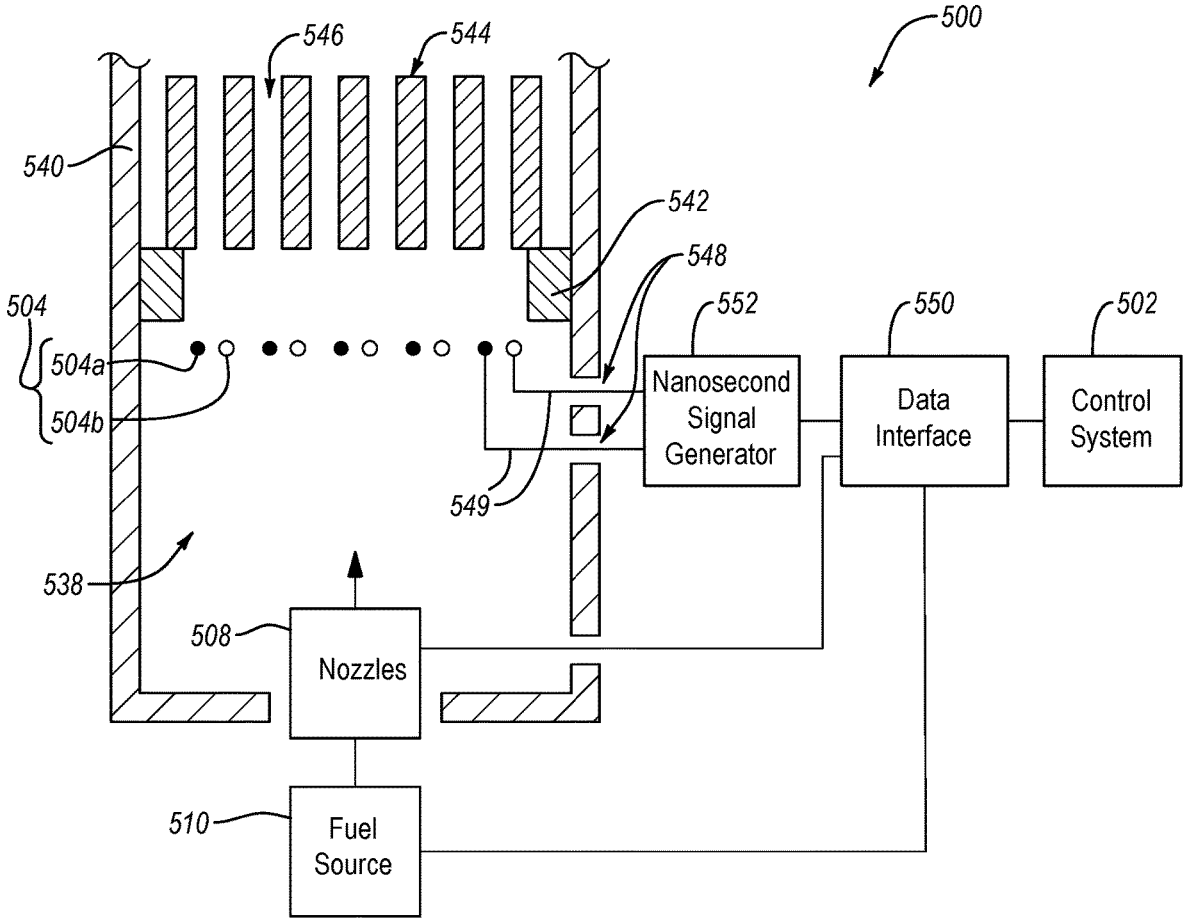
FIG. 5A is a schematic cross-sectional view of a burner system, according to an embodiment.

FIG. 5A is a schematic cross-sectional view of a burner system 500, according to an embodiment. Except as otherwise disclosed herein, the burner system 500 may be the same as or substantially similar to any of the other burner systems disclosed herein. For example, the burner system 500 may include one or more electrodynamic components and one or more burner components. The electrodynamic components may include one or more electrodes 504 and an electrode controller (illustrated as nanosecond signal generator 552). The burner components may include one or more nozzles 508 (e.g., the nozzles 508 form part of a burner) and a fuel source 510. The burner system 500 may also include a data interface 550 and a control system 502.

The one or more electrodes 504 may be dielectric barrier discharge electrodes that are configured to produce cold plasma discharge (a.k.a., photonic discharge or low temperature discharge). The one or more electrodes 504 may include at least one first electrode 504*a* (e.g., a plurality of first electrodes 504*a*) and at least one second electrode 504*b* (e.g., a plurality of second electrodes 504*b*) positioned proximate to the at least one first electrode 504*a*. During operation, the first and second electrodes 504*a*, 504*b* have different polarities. In an example, during operation, the first electrode 504*a* may have a positive polarity while the second electrode 504*b* has a negative polarity. In an example, during operation, the first electrode 504*a* may have a negative or positive polarity while the second electrode 504*b* has neutral polarity (i.e., the second electrode 504*b* is a ground electrode).

In an embodiment, the at least one first electrode 504*a* includes a plurality of first electrodes 504*a* and the at least one second electrode 504*b* includes a plurality of second electrodes 504*b*. In such an embodiment, the first and second electrodes 504*a*, 504*b*, are alternatively positioned in a plane which allows the first and second electrodes 504*a*, 504*b* to affect a large percentage of the fuel and/or flame.

The one or more electrodes 504 may exhibit any suitable shape. For example, as illustrated, each of the one or more electrodes 504 may exhibit a generally elongated shape. The elongated shape may include, for example, a rod-like shape since the rod-like shape forms a more uniform electric fields than a shape that includes a corner. In an embodiment, the elongated shape of the electrodes 504 may extend in a direction that is generally perpendicular to the flow of fuel from the nozzles 508 (shown with an arrow) which allows the electrodes 504 to affect a larger quantity of the fuel and/or flame with fewer electrodes than if the elongated shape of the electrodes 504 extended in a non-perpendicular direction relative to the flow of the fuel.

Figure 5B:
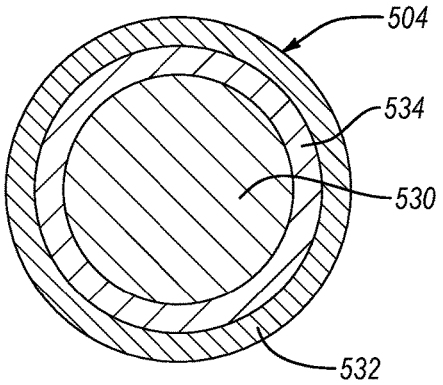
FIG. 5B is a cross-sectional view of one of the electrodes, according to an embodiment.

FIG. 5B is a cross-sectional view of one of the electrodes 504, according to an embodiment. The electrodes 504 may include a core 530 that is electrically conductive and forms a high voltage electrode. Due to the temperatures generated by the burner system 500, the core 530 may include a conductor exhibiting a high melting point, such as steel (e.g., stainless steel) or a superalloy (e.g., Hastelloy® or Inconel®).

The core 530 may be at least partially surrounded by a dielectric layer 532 (e.g., a dielectric coating). The dielectric layer 532 may be formed on the core 530 such that the dielectric layer 532 is positioned between the core 530 and a core of an adjacent electrode. It is noted that the adjacent electrode may or may not include a dielectric layer positioned between the core of the adjacent electrode and the core 530 of the electrode 504. In an example, the dielectric layer 532 may completely surround the core 530, thereby ensuring that the dielectric layer 532 is positioned between the core 530 and the core of the adjacent electrode. Due to the temperatures generated by the burner system 500, the dielectric layer 532 may also be formed from a material exhibiting a high melting point, such as zirconium oxide or another oxide. Forming the dielectric layer 532 from an oxide may prevent oxygen radicals that are formed during operation from corroding the dielectric layer 532.

In an embodiment, the electrode 504 may include a tie layer 534 disposed between the core 530 and the dielectric layer 532. The tie layer 534 may improve adhesion between the core 530 and the dielectric layer 532. The tie layer 534 may include, for example, titanium, molybdenum, chromium, aluminum, yttrium, nickel, cobalt, oxides thereof, or combinations thereof.

Referring back to FIG. 5A, the first and second electrodes 504*a*, 504*b* may be electrically coupled to and receive electrical energy from the electrode controller. The electrical energy received from the electrode controller may be selected based on the desired effect that the first and second electrodes 504*a*, 504*b* have on a flame (not shown). The electrical energy received from the electrode controller may depend on commands from the data interface 550, such as commands generated by the data interface 550 using a LUT. In an embodiment, the electrical energy received from the electrode controller may be less than about 220 Watts ("W"), such as less than about 200 W, less than about 175 W, less than about 150 W, less than about 125 W, less than about 100 W, less than about 75 W, or in ranges of about 150 W to about 200 W, about 125 W to about 175 W, about 100 W to about 150 W, or about 75 W to about 125 W. The wattage may be selected based on the voltage between the first and second electrodes 504*a*, 504*b*, the maximum allowable current between the first and second electrodes 504*a*, 504*b*, the desired amount of electrons ejected from the first and second electrodes 504*a*, 504*b* (e.g., increasing the wattage may increase the amount of electrons), and/or the desired amount of radicals formed by the first and second electrodes 504*a*, 504*b* (e.g., increasing the wattage may increase the amount of radicals forms). In an embodiment, the electrical energy received from the electrode controller may have an electric potential between the first and second electrodes 504*a*, 504*b* be about 5 kilovolts ("kV") to about 40 kV, such as in ranges of about 5 kV to about 15 kV, about 10 kV to about 20 kV, about 15 kV to about 25 kV, about 20 kV to about 30 kV, about 25 kV to about 35 kV, or about 30 kV to about 40 kV. The voltage of the electrical energy may be selected based on the desired wattage of the electrical energy, the desired amount of electrons ejected from the first and second electrodes 504*a*, 504*b* (e.g., increasing the voltage may increase the amount of electrons), and/or the desired amount of radicals formed by the first and second electrodes 504*a*, 504*b* (e.g., increasing the voltage may increase the amount of radicals forms). In an embodiment, the electrical energy received from the electrode controller may cause a maximum current between the first and second electrodes 504*a*, 504*b* that is less than about 5 milliamperes ("mA"), such as less than about 4 mA, less than about 3 mA, less than about 2 mA, less than about 1 mA, less than about 0.5 mA, or in ranges of about 0.5 mA to about 2 mA, about 1 mA to about 3 mA, about 2 mA to about 4 mA, or about 3 mA to about 5 mA. The current of the electrical energy may be selected based on the desired wattage of the electrical energy, the desired amount of electrons ejected from the first and second electrodes 504*a*, 504*b* (e.g., increasing the current may increase the amount of electrons), and/or the desired amount of radicals formed by the first and second electrodes 504*a*, 504*b* (e.g., increasing the current may increase the amount of radicals forms). In an embodiment, the electrical energy received from the electrode controller may exhibit a frequency in the kilohertz to megahertz range. In an embodiment, the electrical energy received from the electrode controller may exhibit a square or truncated triangular signal.

In an embodiment, as previously discussed, the electrode controller may be or include a nanosecond signal generator. The nanosecond signal generator is configured to cause the electrodes to emit an electric field having a nanosecond pulse length. As used herein, a nanosecond pulse length refers to a pulse length of about 0.1 nanoseconds ("ns") to about 100 ns, such as in ranges of about 0.1 ns to about 1 ns, about 0.5 ns to about 5 ns, about 1 ns to about 10 ns, about 5 ns to about 15 ns, about 10 ns to about 30 ns, about 20 ns to about 40 ns, about 30 ns to about 50 ns, about 40 ns to about 60 ns, about 50 ns to about 70 ns, about 60 ns to about 80 ns, about 70 ns to about 90 ns, or about 80 ns to about 100 ns. The nanosecond pulse length causes the first and second electrodes 504*a*, 504*b* to generate cold plasma discharge instead of, for example, hot plasma discharge.

Not wishing to be bound by theory, during operation, electrical charges are provided to at least one of the first electrode 504*a* or the second electrode 504*b*. For example, the electrical charges may be provided to the first electrode 504*a* while the second electrode remains neutral. The electrical charges collect on the surface of the dielectric layer 532 before discharging. Discharging the electrical charges may result in electrons being released from the electrodes 504. The electrons may react with gas molecules to form radicals. For example, the electrons may react with oxygen gas to form an oxygen radical.

The presence of the radical may affect the combustion reaction of the fuel thereby making the fuel combustion more stable. For example, the presence of the radical may reduce the minimum stable fuel rate. Further, the presence of the radicals may increase the turndown ratio of the burner system 500 by at least 5% (e.g., at least about 10%, at least about 30%, at least about 50%, about 20% to about 60%, or about 20% to about 50%) compared to a substantially similar burner system that is configured to form ions or hot plasma discharge. Turndown ratio is the maximum stable fuel rate minus the minimum stable fuel rate all divided by the maximum stable fuel rate. However, it is noted that the radicals may not have sufficient energy to ignite the fuel (e.g., the burner system 500 may need an ignition source other than the electrodes 504) though the radicals may have sufficient energy to maintain ignition of the fuel.

Forming radicals with the electrodes 504 instead of forming ions or hot plasma discharge may be more energy efficient. Further, forming radicals may increase the lifespan of the electrodes 504 since the discharge is less intense than other types of discharge (e.g., discharge caused by corona electrodes).

The burner system 500 includes a combustion chamber 538 defined by one or more walls 540. The combustion chamber 538 is configured to receive the fuel from the nozzles 508 and have the fuel combust therein. In an embodiment, the electrodes 504 are at least partially disposed in the combustion chamber 538. In such an embodiment, the walls 540 may define one or more openings 548 therein that allow the electrodes 504 to be electrically coupled (e.g., via one or more wires 549) to the electrode controller.

The burner system 500 may include a perforated flame holder 544 disposed in the combustion chamber 538. The perforated flame holder 554 may be attached to the walls 540, thereby allowing the perforated flame holder 554 to be supported above the nozzles 508. In an embodiment, the perforated flame holder 544 may be supported above the nozzles 508 by one or more support structures 542. For example, the support structure 542 may be blocks or other structure that are attached to or otherwise protrudes from the walls 540. In such an example, the perforated flame holder 544 may rest on or be otherwise attached to the support structures 542.

The perforated flame holder 544 is configured to facilitate combustion of the fuel. For example, the perforated flame holder 544 defines a plurality of passageways 546 extending therethrough. The fuel may be dispensed from the nozzles 508 towards the perforated flame holder 544. The passageways 544 may receive the fuel and may increase mixing of the fuel and an oxidant source thereby resulting in better combustion of the fuel. The passageways 544 may also decrease the speed of the fuel thereby decreasing the odds of blowout. Further, the passageways 544 may have at least some of the fuel combust therein which may result in a more stable flame and more efficient transfer of heat from the flame. Examples of perforated flame holders are disclosed in U.S. patent application Ser. No. 15/521,011 filed on Apr. 21, 2017, the disclosure of which is incorporated herein, in its entirety, by this reference. In an embodiment, the perforated flame holder 544 is omitted from the burner system 500.

In an embodiment, as illustrated, the electrodes 504 may be disposed in the combustion chamber 538 between the nozzles 508 and the perforated flame holder 544. In other words, the electrodes 504 may be disposed below the perforated flame holder 544. Disposing the electrodes 504 below the perforated flame holder 544 may allow the radicals to be formed in the fuel before the fuel reaches the perforated flame holder 544. In an embodiment, the fuel may combust at or near the perforated flame holder 544. In such an embodiment, disposing the electrodes 504 below the perforated flame holder 544 may affect the combustion reaction, such as affect the combustion reactions that occur at or near the bottom of the flame (e.g., the portion of the flame closest to the nozzles 508).

Figure 6:
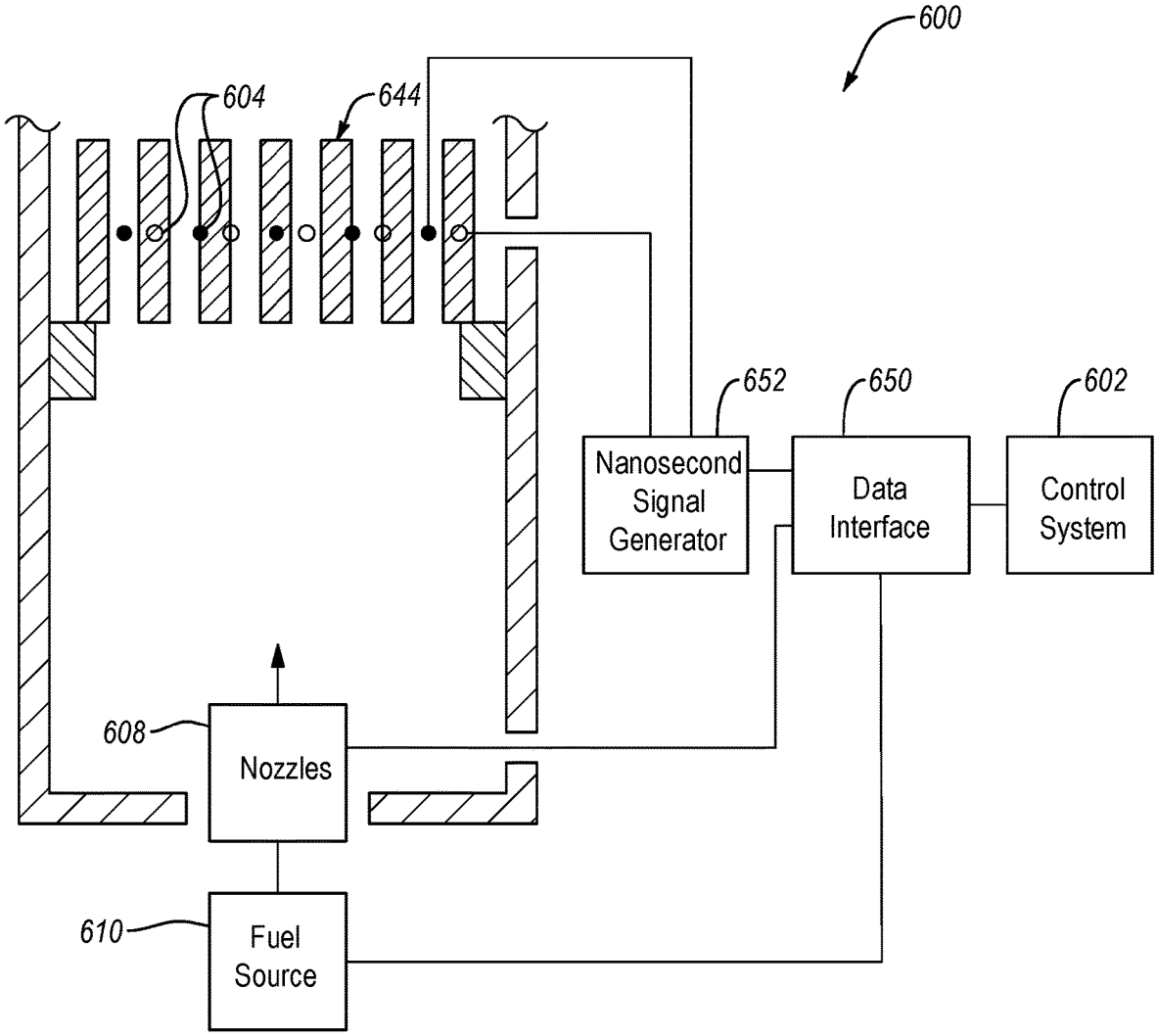
FIG. 6 is a schematic cross-sectional view of a burner system, according to an embodiment.

It is noted that the electrodes may have other positions relative to the perforated flame holder other than the position shown in FIG. 5A. For example, FIG. 6 is a schematic cross-sectional view of a burner system 600, according to an embodiment. Except as otherwise disclosed herein, the burner system 600 is the same as or substantially similar to any of the burner systems disclosed herein. For example, the burner system 600 includes one or more burner components (e.g., nozzles 608, fuel source 610, perforated flame holder 644), one or more electrodynamic components (e.g., electrodes 604, nanosecond signal generator 652), a data interface 650, and a control system 602.

In the illustrated embodiment, the one or more electrodes 604 are disposed in the perforated flame holder 644. For example, the perforated flame holder 644 may define one or more conduits therein that are configured to have the one or more electrodes 604 disposed therein or the perforated flame holder 644 may be formed from two or more components with the one or more electrodes 604 disposed between the two or more components. Disposing the electrodes 604 in the perforated flame holder 644 may cause the electrodes 604 to be disposed in the flame. Disposing the electrodes 604 in the perforated flame holder 644 may allow the electrodes 604 to affect the combustion reactions, such as when at least a portion of the fuel combusts within or directly above the perforated flame holder 644.

Figure 7:
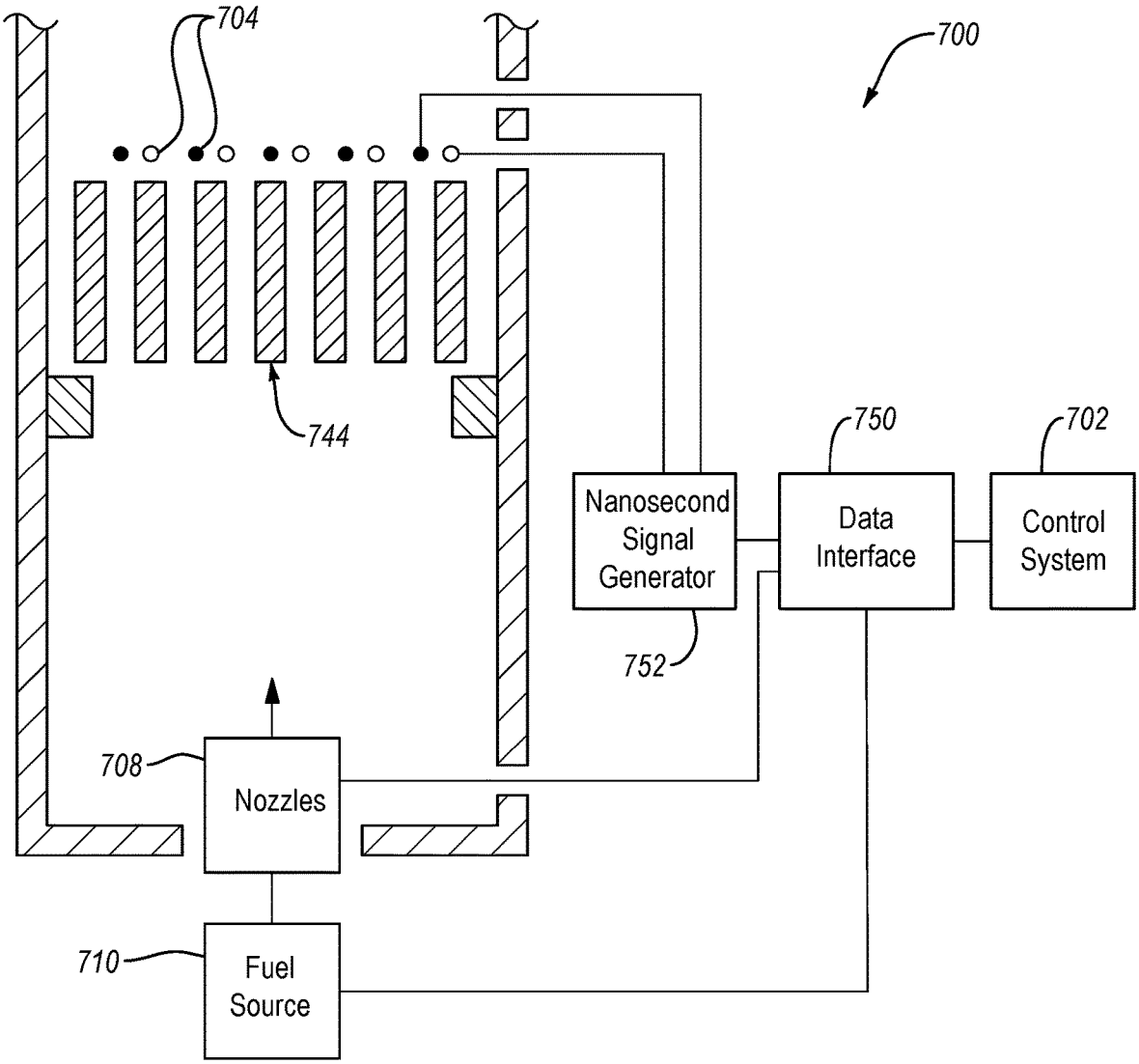
FIG. 7 is a schematic cross-sectional view of a burner system, according to an embodiment.

FIG. 7 is a schematic cross-sectional view of a burner system 700, according to an embodiment. Except as otherwise disclosed herein, the burner system 700 is the same as or substantially similar to any of the burner systems disclosed herein. For example, the burner system 700 includes one or more burner components (e.g., nozzles 708, fuel source 710, perforated flame holder 744), one or more electrodynamic components (e.g., electrodes 704, nanosecond signal generator 752), a data interface 750, and a control system 702.

In the illustrated embodiment, the one or more electrodes 704 are disposed above the perforated flame holder 744. In other words, the perforated flame holder 744 is positioned between the electrodes 704 and the nozzles 708. The electrodes 704 that are disposed above the perforated flame holder 744 may be positioned in the flame or above the flame. The electrodes 704 may be disposed above the perforated flame holder 744, for example, to affect combustion of at least a portion of the fuel that combusts above the perforated flame holder 744. Further, positioning the electrodes 704 above the perforated flame holder 744 may facilitate combustion of fuel that, except for the electrodes 704, would not have combusted.

Figure 8:
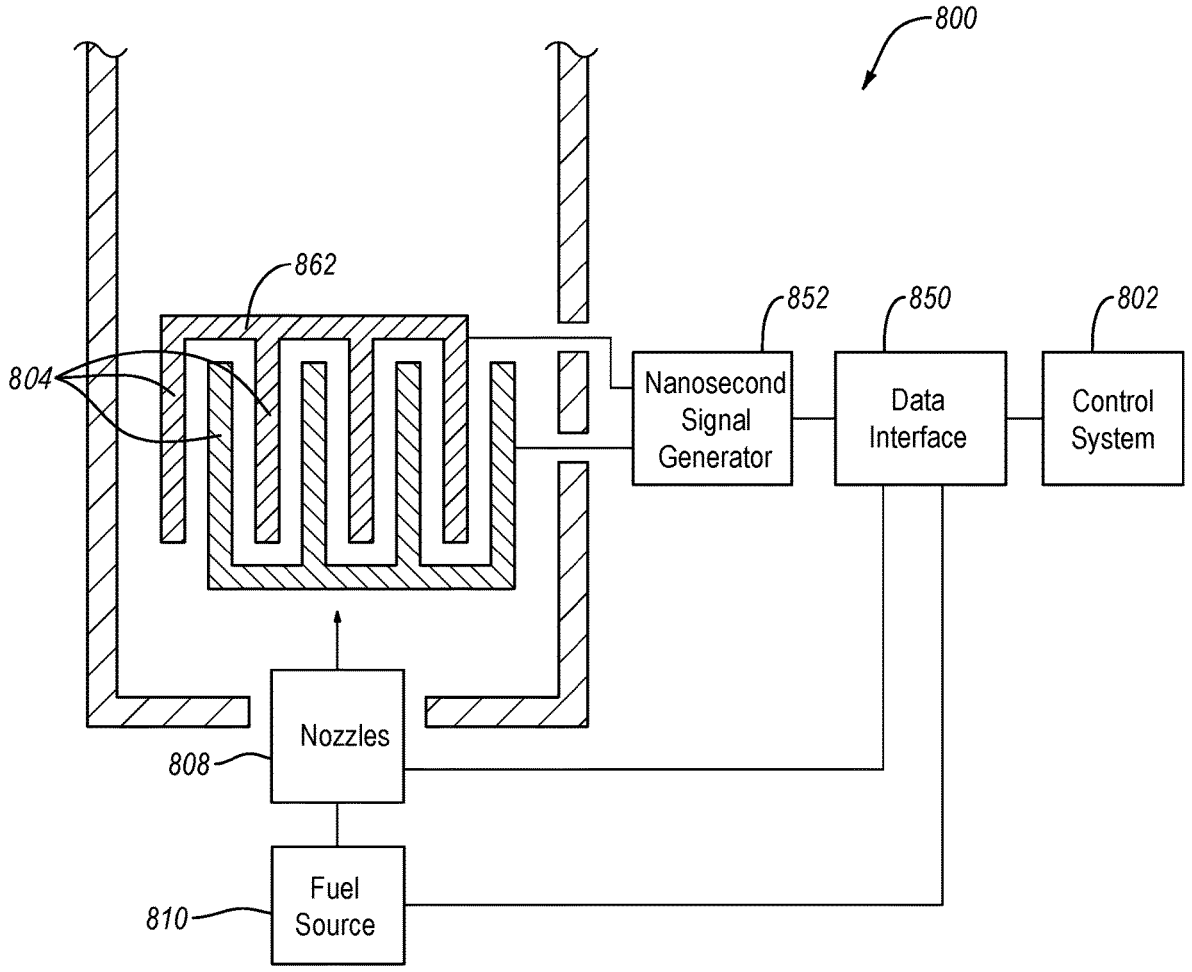
FIG. 8 is a schematic cross-sectional view of a burner system, according to an embodiment.

The electrodes 504, 604, and 704 of FIGS. 5A to 7 extend in a longitudinal direction that is generally perpendicular to the flow of fuel. However, it is noted that any of the electrodes disclosed herein may extend in a longitudinal direction that is not generally perpendicular to the flow of fuel. For example, FIG. 8 is a schematic cross-sectional view of a burner system 800, according to an embodiment. Except as otherwise disclosed herein, the burner system 800 is the same as or substantially similar to any of the burner systems disclosed herein. For example, the burner system 800 may include one or more burner components (e.g., nozzles 808 and fuel source 810), one or more electrodynamic components (e.g., electrodes 804, nanosecond signal generator 852), a data interface 850, and a control system 802.

The electrodes 804 extend in a longitudinal direct. In an embodiment, each of the electrodes 804 are generally parallel to each other thereby facilitating a uniform electric field therebetween. Each of the plurality of electrodes 804 may be electrically coupled together using any suitable technique. For example, as illustrated, the electrodes 804 may be electrically coupled together using an electrically conductive support 862 attached to or integrally formed with the electrodes 862. In such an example, the electrodes 804 may extend longitudinally from the support 862. However, the electrodes 804 may be electrically coupled together using other techniques, such as with electrically conductive wires.

In an example, as illustrated, at least a portion of the electrodes 804 may extend in a longitudinal direction that is generally parallel to the flow of the fuel. In such an example, the electrodes 804 may eject ions, electrons, and/or radicals into the fuel and/or flame along a longer path of the fuel and/or flame. In an example (not illustrated), at least a portion of the electrodes 804 may extend in at an oblique angle relative to the flow of the fuel.

The embodiments disclosed herein, including the control system and/or the data interface, may comprise a special purpose or general-purpose computer including various computer hardware or other hardware including duplexers, amplifiers, or the like, as discussed in greater detail below.

Embodiments disclosed herein also include computer-readable media for carrying or having computer-executable instructions or data structures stored thereon. Such computer-readable media may be any available media that may be accessed by a general purpose or special purpose computer. By way of example, and not limitation, such computer-readable media may comprise RAM, ROM, EEPROM, CD-ROM or other optical disk storage, magnetic disk storage or other magnetic storage devices, or any other medium which may be used to carry or store desired program code means in the form of computer-executable instructions or data structures and which may be accessed by a general purpose or special purpose computer. Combinations of the above should also be included within the scope of computer-readable media.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

While various aspects and embodiments have been disclosed, other aspects and embodiments may be contemplated. The various aspects and embodiments disclosed here are for purposes of illustration and are not intended to be limiting, with the true scope and spirit being indicated by the following claims.

What is claimed is:

1. A retrofit flame control system, comprising:

one or more electrodynamic components configured for integration with an existing burner system capable of producing a flame, the one or more electrodynamic components including:

one or more electrodes configured to generate an electric field for controlling one or more characteristics of the flame; and one or more chargers configured to charge the flame;

a data interface configured to receive a first command for controlling one or more burner components and prepare a second command for controlling the one or more electrodynamic components, the second command being at least partially based on the first command.

2. The retrofit flame control system of claim 1, wherein the data interface is configured to access a lookup table containing information for preparing the second command at least partially based on the first command.

3. The retrofit flame control system of claim 2, wherein the lookup table includes a database.

4. The retrofit flame control system of claim 1, further comprising a control system coupled to the data interface and configured to output the first command.

5. The retrofit flame control system of claim 1, further comprising an electrode controller that is coupled to the data interface and associated with the one or more electrodes.

6. The retrofit flame control system of claim 1, further comprising a charger controller that is coupled to the data interface and associated with the one or more chargers.

7. The retrofit flame control system of claim 1, further comprising a burner controller that is coupled to the data interface and associated with a burner of the one or more burner components.

8. The retrofit flame control system of claim 1, further comprising a fuel source controller that is coupled to the data interface and associated with a fuel source of the one or more burner components.

9. The retrofit flame control system of claim 1, further comprising one or more of a fuel component control connected to the existing burner system or an electrodynamic component control connected to at least one of the one or more electrodynamic components or the fuel component control, and wherein the electrodynamic component control being configured to receive commands from the data interface.

10. The retrofit flame control system of claim 9, wherein the fuel component control is configured to control at least one of supply of fuel to a flame area or fuel mixture for forming the flame in the flame area.

11. The retrofit flame control system of claim 9, wherein the electrodynamic component control is configured to control one or more characteristics of the flame.

12. The retrofit flame control system of claim 9, wherein:

the fuel component control is configured to identify and send commands intended for the existing burner system to one or more components of the existing burner system; and the electrodynamic component control is configured to identify and send commands intended for one or more of the electrodynamic components to the one or more of the electrodynamic components.

13. The retrofit flame control system of claim 12, wherein:

the fuel component control is further configured to identify and send commands intended for the one or more electrodynamic components to the electrodynamic component control; and the electrodynamic component control is configured to identify and send commands intended for the one or more components of the existing burner system to the fuel component control.

14. The retrofit flame control system of claim 1, further comprising the one or more burner components configured for integration with the existing burner system, the one or more burner components configured to control at least one of supply of fuel to a flame area or fuel mixture for forming the flame in the flame area.

15. A retrofit flame control system, comprising:

one or more electrodynamic components configured for integration with an existing burner system capable of producing a flame, the one or more electrodynamic components including:

one or more electrodes configured to generate an electric field for controlling one or more characteristics of the flame;

one or more chargers configured to charge the flame;

a data interface configured to:

receive a first command for controlling one or more burner components;

prepare a second command for controlling the one or more electrodynamic components, the second command being at least partially based on the first command; and access a lookup table containing information for preparing the second command at least partially based on the first command;

a fuel component control connected to the existing burner system and the data interface; and an electrodynamic component control connected to the data interface and at least one of the one or more electrodynamic components or the fuel component control.

16. The retrofit flame control system of claim 15, wherein the fuel component control includes at least one of a burner controller that is associated with a burner of the existing burner system or a fuel source controller that is associated with a fuel source of the existing burner system.

17. The retrofit flame control system of claim 15, wherein the electrodynamic component control includes at least one of an electrode controller that is associated with the one or more electrodes or a charger controller that is associated with the one or more chargers.

18. A retrofit flame control system, comprising:

one or more electrodynamic components configured for integration with an existing burner system capable of producing a flame, the one or more electrodynamic components including:

one or more first electrodes; and one or more second electrodes configured to be positioned proximate to the first electrode;

a data interface configured to receive a first command for controlling one or more burner components and prepare a second command for controlling the one or more electrodynamic components, the second command being at least partially based on the first command.

19. The burner system of claim 18, wherein one or more of the at least one first electrode or the at least one second electrode form a dielectric barrier discharge device.

20. The burner system of claim 18, wherein the second command includes controlling a pulse signal generator to provide pulsed electrical energy to at least one of the at least one first electrode or the at least one second electrode, wherein the pulse signal generator is configured to provide the pulsed electrical energy exhibiting a pulse duration of about 0.1 nanosecond to about 100 nanoseconds.

* * * * *